US006705704B2

(12) United States Patent
Harvey et al.

(10) Patent No.: US 6,705,704 B2
(45) Date of Patent: Mar. 16, 2004

(54) DROPLET DEPOSITION METHOD AND APPARATUS

(75) Inventors: Robert A. Harvey, Cambridge (GB); Paul R. Drury, Royston (GB)

(73) Assignee: XAAR Technology Limited, Cambridge (GB)

( * ) Notice: Subject to any disclaimer, the term of this patent is extended or adjusted under 35 U.S.C. 154(b) by 83 days.

(21) Appl. No.: 10/060,111

(22) Filed: Jan. 29, 2002

(65) Prior Publication Data

US 2003/0016256 A1 Jan. 23, 2003

Related U.S. Application Data

(63) Continuation of application No. PCT/GB00/02918, filed on Jul. 28, 2000.

(30) Foreign Application Priority Data

Jul. 30, 1999 (GB) ..... 9917996

(51) Int. Cl.[7] ..... B41J 2/14; B41J 2/045
(52) U.S. Cl. ..... 347/47; 347/69
(58) Field of Search ..... 347/10, 11, 68, 347/69, 47; 29/25.5

(56) References Cited

U.S. PATENT DOCUMENTS

| | | | | |
|---|---|---|---|---|
| 4,104,645 A | | 8/1978 | Fischbeck | 346/140 R |
| 4,199,770 A | | 4/1980 | Schnarr | 346/140 R |
| 4,326,205 A | | 4/1982 | Fischbeck et al. | 346/140 R |
| 4,432,003 A | | 2/1984 | Barbero et al. | 346/140 R |
| 4,435,721 A | | 3/1984 | Tsuzuki et al. | 346/140 R |
| 4,549,191 A | | 10/1985 | Fukuchi et al. | 346/140 R |
| 5,016,028 A | * | 5/1991 | Temple | 347/69 |
| 5,097,275 A | | 3/1992 | Takita | 346/140 R |
| 5,406,319 A | * | 4/1995 | Hayes et al. | 347/71 |
| 5,554,247 A | | 9/1996 | Pies et al. | 156/268 |
| 5,581,286 A | | 12/1996 | Hayes et al. | 347/71 |
| 5,619,235 A | * | 4/1997 | Suzuki et al. | 347/69 |
| 5,818,485 A | | 10/1998 | Rezanka | 347/89 |
| 5,906,481 A | * | 5/1999 | Ogawa et al. | 417/413.2 |

FOREIGN PATENT DOCUMENTS

| | | | | |
|---|---|---|---|---|
| EP | 0277703 A1 | * | 8/1988 | 347/69 |
| EP | 0 518 380 B1 | | 12/1992 | |
| EP | 0 277 703 A1 | | 8/1998 | |
| JP | 0 907 6513 A | | 3/1997 | |
| WO | WO 88/10192 | | 12/1988 | |
| WO | WO 98/52763 | | 11/1998 | |

OTHER PUBLICATIONS

International Search Report in PCT/GB00/02918 dated Oct. 18, 2000.

International Preliminary Examination Report in PCT/GB00/02918 dated Oct. 23, 2001.

* cited by examiner

*Primary Examiner*—Russell Adams
*Assistant Examiner*—An H. Do
(74) *Attorney, Agent, or Firm*—Marshall, Gerstein & Borun LLP

(57) ABSTRACT

A droplet deposition apparatus includes an elongate chamber having a nozzle through which in operation droplets of liquid are ejected from the chamber for deposition, means for varying the pressure of liquid in the chamber by varying the volume thereof to effect ejection of the droplets and means for causing a flow of liquid in the chamber in addition to that necessary to replenish the ejected droplets, the flow passing across the nozzle to clean it.

18 Claims, 7 Drawing Sheets

DROPLET DEPOSITION METHOD AND APPARATUS

This is a continuation of International Application No. PCT/GB00/02918 filed Jul. 28, 2000, the entire disclosure of which is incorporated herein by reference.

This invention relates to droplet deposition methods and apparatus in which droplets are ejected from a chamber on demand via a nozzle by varying the volume of the chamber.

The variation of chamber volume preferably is effected by piezoelectric actuators, for example by deflection of piezoelectric material which bounds the chamber. Such an arrangement is shown in our earlier specification EP 0277703A, incorporated herein by reference. Such devices are characterised by elongated ink-containing chambers with nozzles in the end walls of the chambers (known as an "end-shooter" configuration).

A problem with such devices is that during periods of non-use, the ink in the chambers may deteriorate, leading to the accumulation of solid particles at the end of the chamber which may block the nozzle. The same problem may occur, although perhaps to a lesser extent, if the nozzle is in one of the long walls of the chamber eg. mid-way along it (ie. a "side-shooter" configuration). The present invention in its preferred embodiments is directed to solving this problem by providing a cleaning flow across the nozzle.

In one aspect, the invention provides a method of droplet deposition comprising varying the pressure of liquid in an elongated chamber by varying the volume of the chamber to eject droplets through a nozzle at one end thereof for deposition, and causing a flow of the liquid in the chamber in excess of that required to replenish the ejected droplets, the flow passing across the nozzle.

In another aspect, the invention provides droplet deposition apparatus comprising an elongated chamber having at one end thereof a nozzle through which in operation droplets of liquid are ejected from the chamber for deposition, means for varying the pressure of liquid in the chamber by varying the volume of the chamber to effect ejection of said droplets and means for causing a flow of liquid in the chamber in excess of that necessary to replenish the ejected droplets, the flow passing across the nozzle.

In a further aspect the invention provides droplet deposition apparatus comprising an elongated chamber having a nozzle through which in operation droplets of liquid are ejected from the chamber for deposition, means for varying the pressure of liquid in the chamber by varying the volume of the chamber to effect ejection of said droplets, means for causing a flow of liquid through the chamber in excess of that necessary to replenish the ejected droplets, the flow passing across the nozzle, and the chamber having a longitudinal barrier around which the flow passes at an end of the chamber.

The nozzle may be in an end wall of the chamber or in a longitudinal wall thereof.

The chamber may be divided longitudinally by a barrier, the liquid flow being in one direction on one side of the barrier and in an opposite direction on the other.

In a side shooter embodiment there may be at one end of the elongated chamber a plenum chamber through which the liquid flows from one side of the barrier to the other, the plenum chamber being such that pressure waves in the liquid in the elongated chamber are reflected by the liquid in the plenum chamber.

At least one wall of the chamber may be formed of piezoelectric material, and may comprise electrodes to deform the material in shear mode by the application of a potential difference thereto.

In a further aspect the invention provides droplet deposition apparatus comprising an elongated chamber having at an end thereof a nozzle through which in operation droplets of liquid are ejected from the chamber for deposition, at least one longitudinal wall of the chamber being formed of piezoelectric material, electrode means for applying a potential difference to the piezoelectric material to deform it in shear mode and thereby effect ejection of said droplets, and a barrier extending longitudinally of the chamber to define a plurality of flow passages therein, an end of the barrier being spaced from the nozzle whereby a flow of liquid from one flow passage to another passes across the nozzle.

The barrier may extend generally plane-parallel to the longitudinal wall.

Alternatively, the longitudinal wall may be divided longitudinally by the barrier.

The piezoelectric material may comprise oppositely-poled regions, one on each side of the barrier whereby application of the potential difference to the material deforms it into a chevron shape.

Alternatively the piezoelectric material on each side of the barrier may comprise oppositely-poled regions whereby application of the potential difference to the material deforms it into a chevron shape on each side of the barrier.

The barrier may contain the axis of the nozzle.

The barrier may comprise a longitudinal wall of piezoelectric material having a first electrode at ground potential on one side of the wall and exposed to the liquid, and a second electrode on the other side of the wall and which is not exposed to the liquid.

Thus the barrier may comprise two said walls, each with a said one side exposed to the liquid, the said other sides of each wall being spaced from and facing towards each other.

There may be comprising an apertured plate disposed between an end of the barrier and structure forming an end wall of the chamber wherein the nozzle is defined.

The invention also comprises a printer operating by a method or including apparatus as set forth above.

The invention will now be described merely by way of example with reference to the accompanying drawings, wherein.

Figure 1:
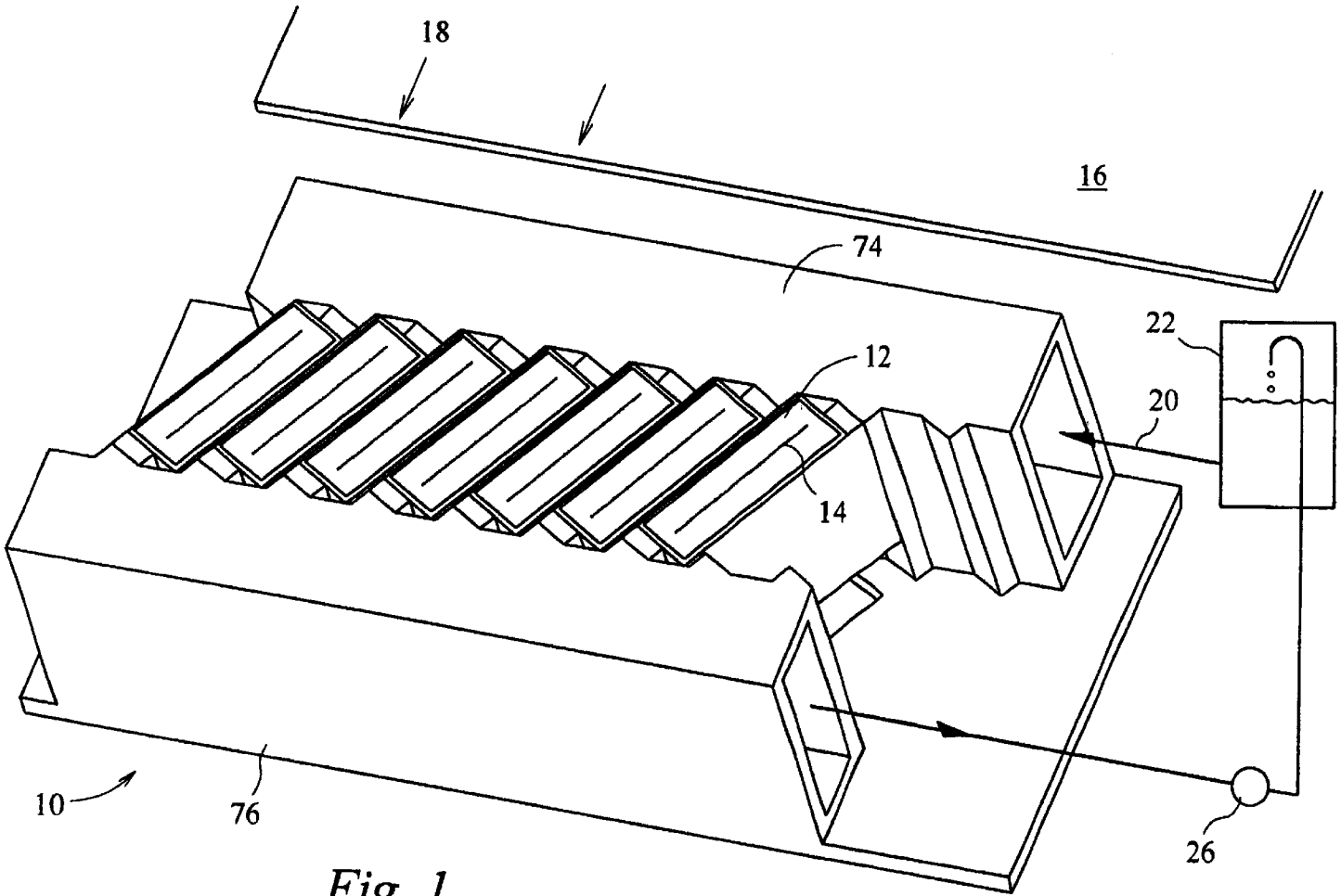
FIG. 1 shows a print head according to the invention.

Referring to FIG. 1, a printer comprises (so far as relevant to this invention) a page-wide array print head 10 which includes a number of print-head modules 12 each with 64 channels terminating in a nozzle 14. Paper or another print medium 16 is traversed past the print head as indicated by arrows 18, and a printed image of dots is formed by the deposition of droplets from the nozzle in a programmed sequence. The modules 12 are angled relative to the paper feed direction in order to increase the print resolution (decrease the dot spacing).

Instead of a page-wide array, a smaller number of modules 12 (or indeed a single module) could be employed in conjunction with a suitable traversing mechanism for moving the module or modules back and forth across the width of the paper as known per se. However a page-wide array is shown because the problem of keeping the nozzles clean is particularly important in a page-wide array which has a large number of nozzles. Ink is supplied as indicated by arrow 20 from a header tank 22, at a rate greater than required for deposition of droplets, is circulated by gravity through the print head as described hereafter, and returns via a collecting tank or sump and a pump 26 to the header tank 22. The pressure provided by the header tank for circulation through the print head is typically 10 mm of water.

Figures 2A, 2B:
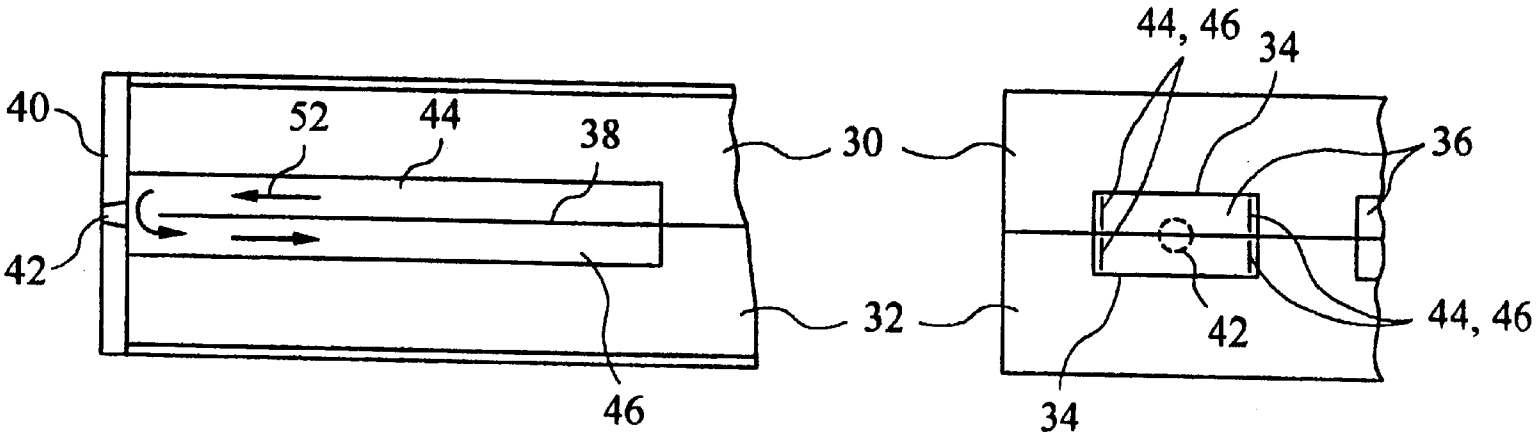
FIGS. 2A, 2B and 2C shows a longitudinal section, a cross-section and a perspective view of part of a print head according to the invention.
Figure 2C:
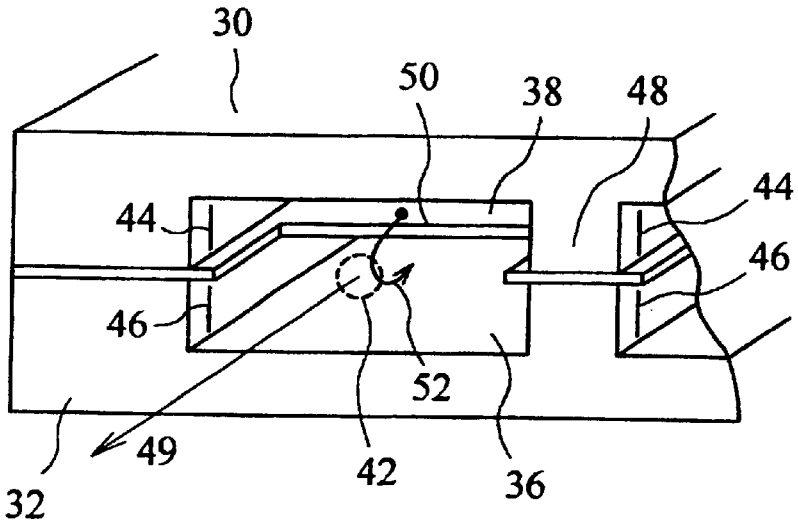

Before considering the structure of the print head modules 12 in more detail, reference is made to FIGS. 2A, 2B and 2C which illustrate the invention diagrammatically.

FIG. 2A is a longitudinal section through a typical print head formed of two wafers 30, 32 of oppositely-poled piezoelectric material such as lead zirconate titanate (PZT). The wafers have parallel channels 34 sawn in them and are assembled face-to-face with the channels in registry so as to form an elongate chamber 36. Between the wafers is a sheet of polyimide material 38 such as UPILEX (trade mark), forming a barrier which divides the chamber into two flow passages. Typically each wafer is about 150 mm thick and the sheet 38 is 20 mm to 50 mm thick. A nozzle plate 40 is disposed across the end of each chamber to close it, and to provide a respective nozzle 42. Electrodes 44, 46 are provided above and below the sheet 38 on each side of the chambers for deflecting the side walls (eg 48) of the chambers in shear mode into a chevron shape so as to vary the volume of the chamber and expel a droplet 49 by means of an acoustic pressure wave as described in EP0277703A.

In each chamber 36 the barrier sheet 38 is cut back at its edge 50 nearest to the nozzle so as to provide a path for ink to flow towards the nozzle along the upper part of the chamber, and away from it along the lower part, as indicated by arrows 52, the flow around the end of the barrier passing over the inner end of the nozzle and cleaning it.

Figure 3:
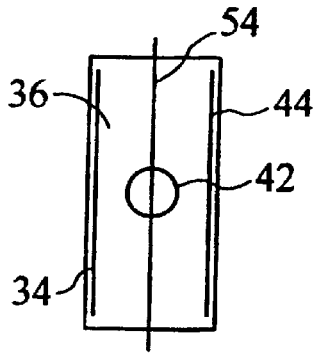
FIG. 3 shows another embodiment of the invention.

It will be appreciated that a barrier may be provided plane-parallel to the electrode-bearing side walls 44 of the chambers, instead of intersecting them, as shown at 54 in FIG. 3.

Figure 4:
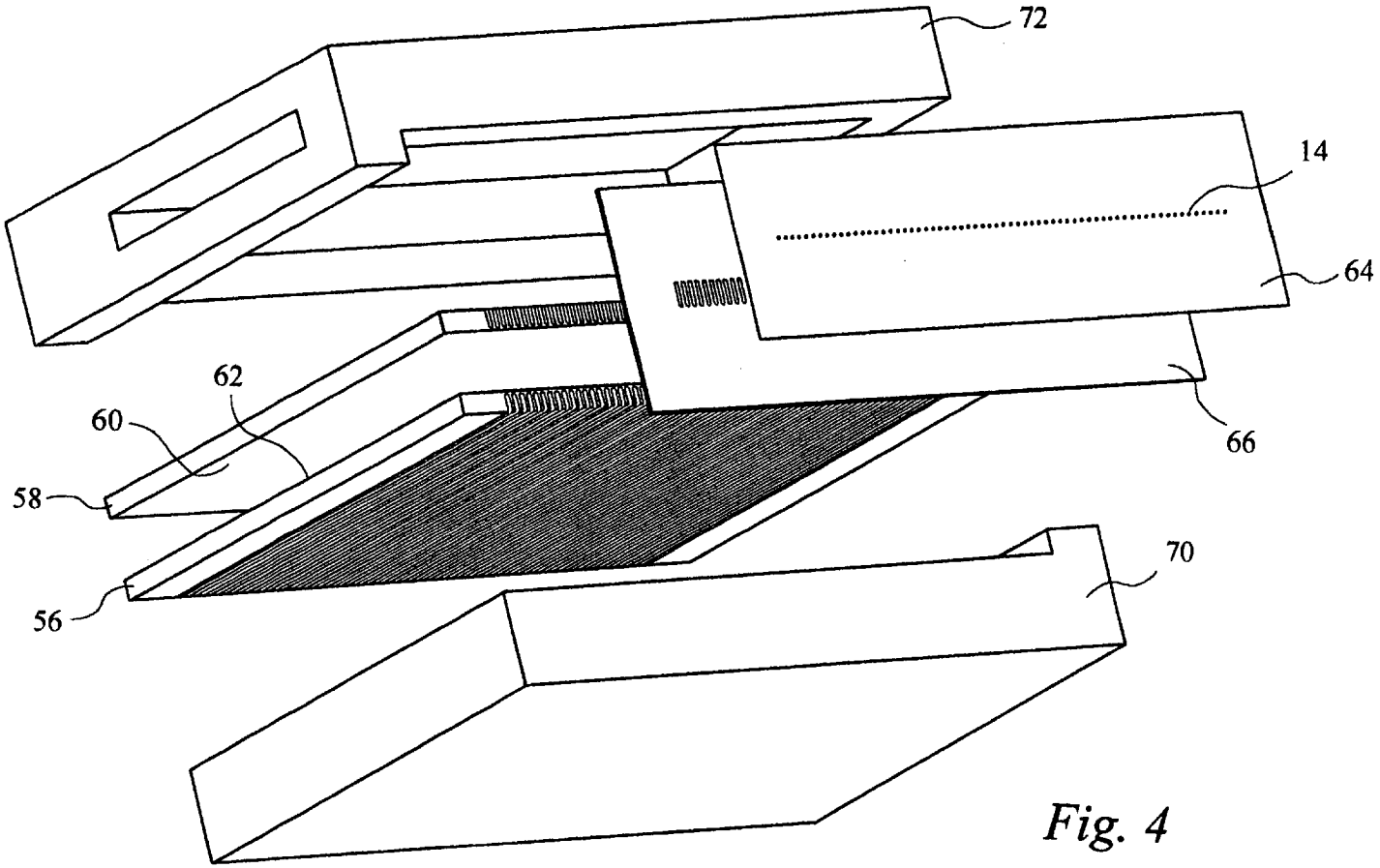
FIG. 4 shows part of the print head of FIG. 1.

FIG. 4 shows an exploded view of one of the print head modules 12. Two oppositely-poled PZT wafers 56, 58, having sawn parallel channels extending partially through their thickness, are assembled back-to-back so that the unsawn portions 60, 62 form a barrier between the two parts of a chamber formed by pairs of registering back-to-back channels. Electrodes are provided similarly to 44, 46 of FIG. 2 in the acoustically-active portions of the channels to deflect the shared walls and expel droplets through nozzles 14 in accordance with known principles. Sandwiched between the ends of wafers 56, 58 and a plate 64 in which the nozzles 14 are provided is a plate 66 in which elongated apertures are defined to connect the channels of each pair across the end of the barrier formed by the unsawn portions 60, 62. Inlet 70 and outlet 72 manifolds are configured also as cover plates to close the open top surfaces of each channel. The assembled module is received in the printhead 10 of FIG. 2 between inlet and outlet plenum chambers 74, 76. In operation ink in excess of that expelled through the nozzle is circulated in each chamber outwardly through wafer 56, across the inner faces of the nozzle via the aperture 68 in plate 66, and returned via wafer 58.

Figure 5:
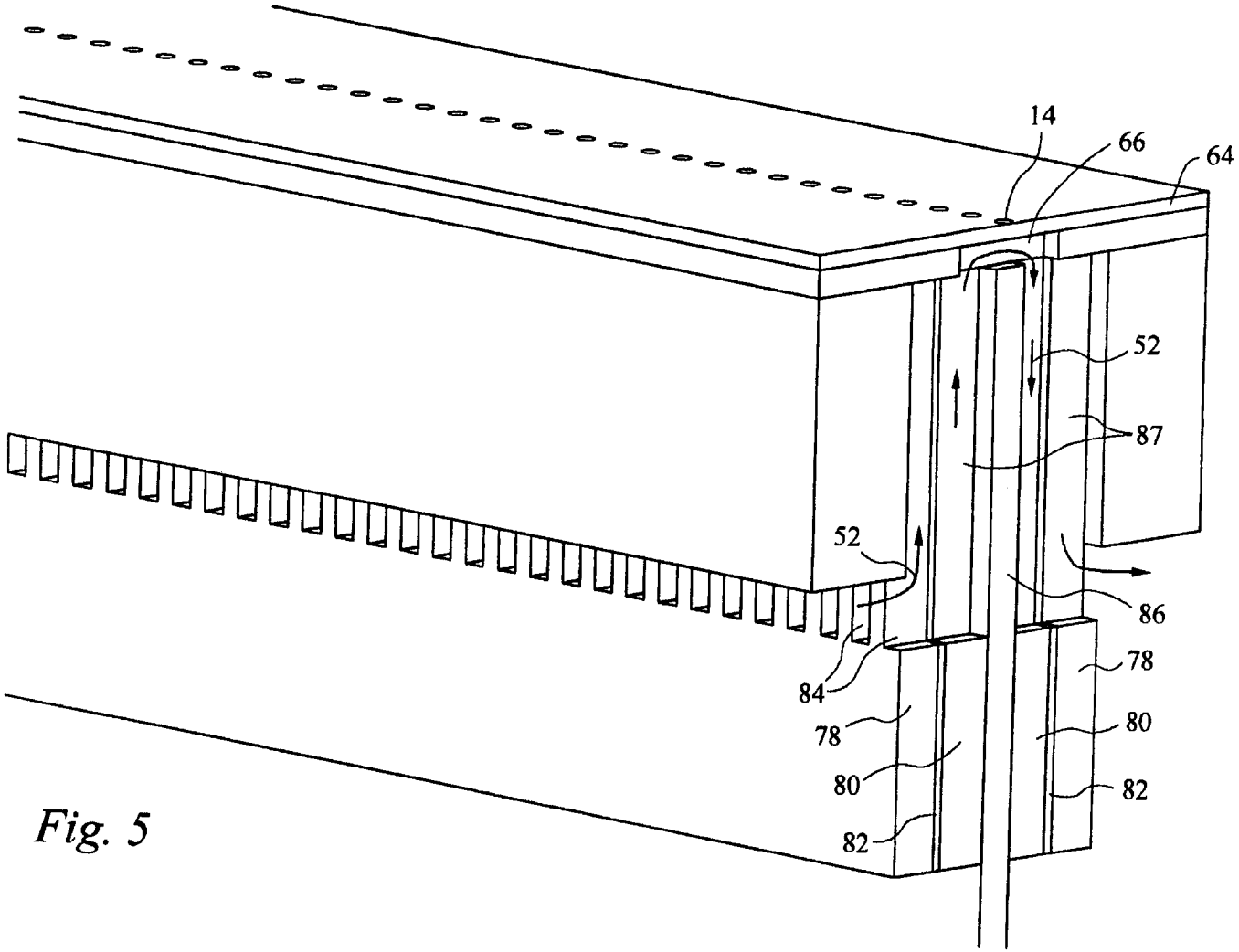
FIG. 5 shows another embodiment of the invention.

FIG. 5 shows a modification of the module of FIG. 4. In this embodiment, the wafers 56, 58 are each replaced by two pairs of wafers 78, 80, oppositely poled to each other and assembled with a layer 82 of adhesive film between them. Channels 84 are sawn completely through both wafers of each pair, and the two pairs of wafers are assembled in registry with each other with a carrier plate 86. The registering pairs of channels together from respective chambers 87 with a barrier constituted by the carrier plate 86 extending longitudinally thereof, circulation around the end of the barrier is via an apertured plate 66, as in FIG. 4, the flow being shown by arrows 52. The barrier 86, as in other embodiments so far described is aligned so as to contain the axes of the nozzles 14. The portions of oppositely-poled piezoelectric material between each channel are fitted with electrodes (not shown) on each side so as to deform to a chevron shape upon application of a driving potential, as described in EP 0277703A.

Figure 6:
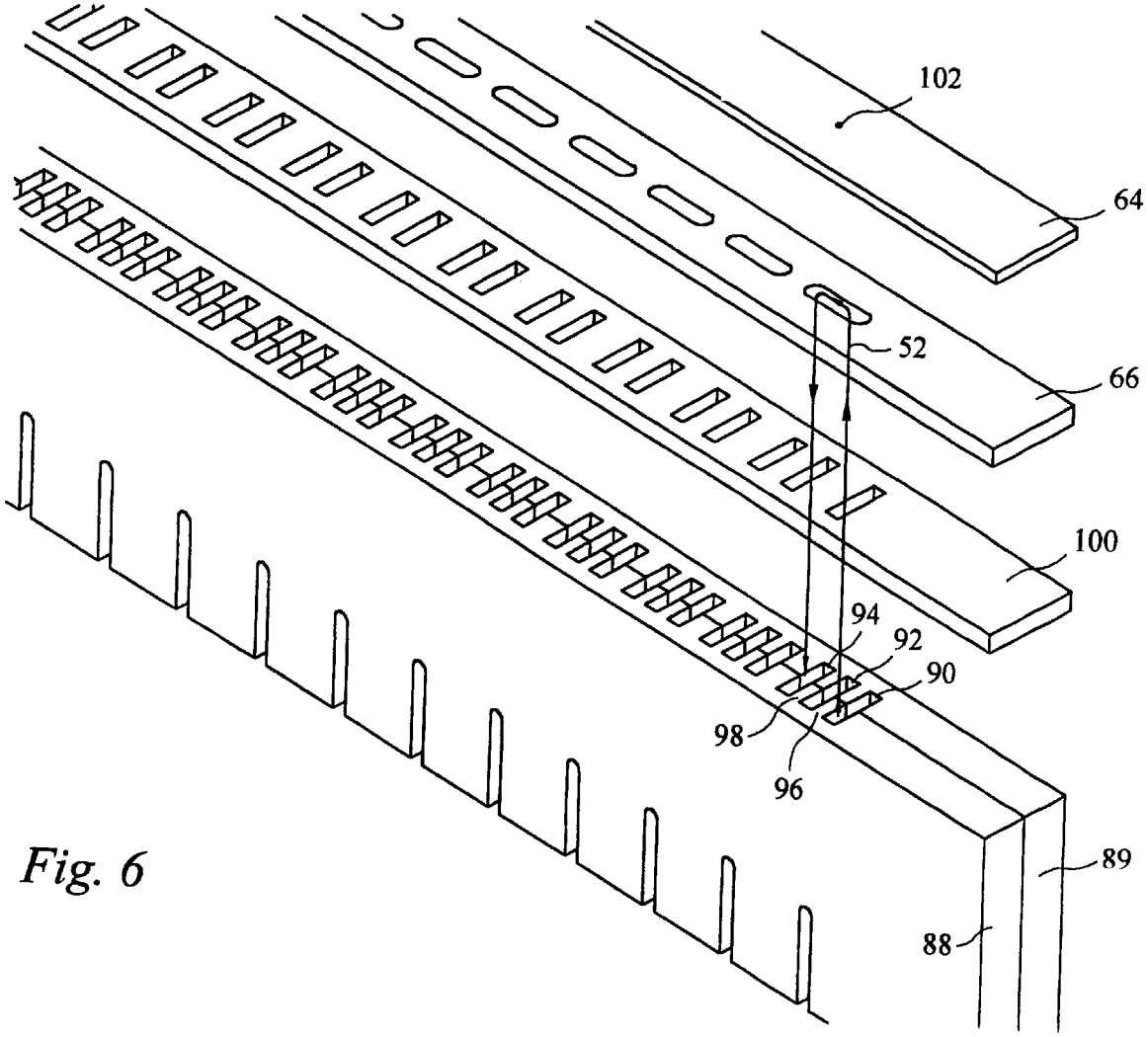
FIG. 6 shows a further embodiment of the invention.

FIG. 6 shows the relevant parts of another embodiment of the invention, in which flow across the face of the nozzle is effected by providing ink circulation around a barrier which includes features which reduce corrosion of the electrodes.

PZT wafers 88, 89 are sawn and abutted face-to-face to form channels 90, 92, 94 in groups of three. Electrodes are provided on the walls 96, 98 between the channels, the ground electrodes being in channels 90 and 94, and the line electrodes in channel 92. This channel is maintained empty of ink either by means of a masking plate 100, or by backfilling it with a flexible sealant. Thereby the only electrodes in contact with the ink are at ground potential, the electrodes at line potential being insulated therefrom. Thus electrolytic corrosion between the electrodes and other conductive parts electrically connected thereto and of different metal is avoided.

Ink is circulated from eg channel 90, around the end of the barrier constituted by the walls 96, 98 and blind channel 92 via apertured plate 66 and returned via channel 94, as shown by arrows 52. The flow passes across nozzle 102 mid-way between channels 90 and 94, aligned with the blanked-off end of blind channel 92. The channels 90, 94 and the aperture in plate 66 thus constitute a single droplet ejecting chamber, containing a barrier 96, 98. In normal circumstances, common signals are applied to the two electrode pairs on wall 96 and wall 98, and also to the electrode pairs on the other longitudinal walls of the channels 90, 94.

Figure 7:
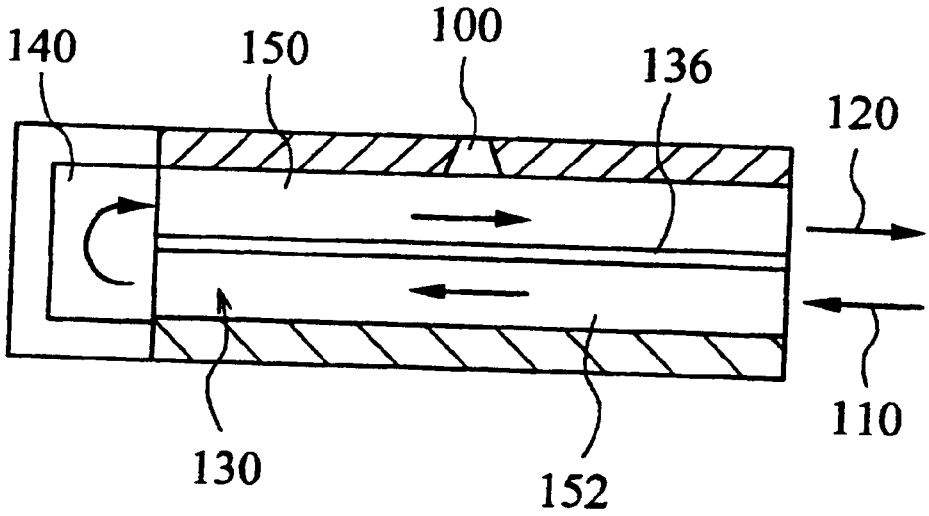
FIG. 7 shows a variation of the embodiment of FIG. 2.

FIG. 7 shows the invention applied in a side shooter printhead. A chamber 130 is divided longitudinally by a barrier 136 to form upper and lower flow passages 150, 152. A plenum chamber 140 at one end of the chamber permits ink flowing outwardly through passage 152 to circulate and return via passage 150.

A nozzle 100 is provided mid-way along passage 150, in the longitudinal top wall of the chamber 130. Ink flowing along the passage 150 scours the inner end of the nozzle 100 and keeps it clean. The volume of the plenum chamber 140 is chosen to be large enough for the ink therein to have a negative reflection coefficient and thereby to reflect pressure waves in the same manner as if it were a manifold connection to an ink inlet or outlet.

A further advantage of this embodiment is that the printhead inlet and outlet connections to the ink supply and return manifolds are both on the same side of the printhead. Manufacture and installation thus are facilitated.

Each feature disclosed in this specification (which term includes the claims) and/or shown in the drawings may be incorporated in the invention independently of other disclosed and/or illustrated features.

Statements in this specification of the "objects of the invention" relate to preferred embodiments of the invention, but not necessarily to all embodiments of the invention falling within the claims.

What is claimed is:

1. A method of droplet deposition comprising varying the pressure of liquid in an elongated chamber by varying the volume of the chamber to eject droplets through a nozzle at one end thereof for deposition, and causing a flow of the liquid in the chamber in excess of that required to replenish the ejected droplets, the flow passing across the nozzle, wherein the chamber is divided longitudinally by a barrier, the liquid flow being in one direction on one side of the barrier and in an opposite direction on the other.

2. A method as claimed in claim 1 wherein the volume of the chamber is varied by means of piezoelectric material which bounds the chamber.

3. A method as claimed in claim 2 wherein at least one longitudinal wall of the chamber is formed of the piezoelectric material, and comprises electrodes to deform the material in shear mode by the application of a potential difference thereto.

4. A method as claimed in claim 3 wherein the longitudinal wall is divided longitudinally by the barrier.

5. A method as claimed in claim 4 wherein the piezoelectric material comprises oppositely-poled regions, one on each side of the barrier whereby application of the potential difference to the material deforms it into a chevron shape.

6. A method as claimed in claim 4 wherein the piezoelectric material on each side of the barrier comprises oppositely-poled regions whereby application of the potential difference to the material deforms it into a chevron shape on each side of the barrier.

7. A method as claimed in claim 1 wherein the barrier contains the axis of the nozzle.

8. A method as claimed in claim 1 wherein the barrier comprises a longitudinal wall of piezoelectric material having a first electrode at ground potential on one side of the wall and exposed to the liquid, and a second electrode on the other side of the wall and which is not exposed to the liquid.

9. A method as claimed in claim 8 wherein the barrier comprises two said walls, each with a said one side exposed to the liquid, the said other sides of each wall being spaced from and facing towards each other.

10. A method as claimed in claim 8 comprising an apertured plate disposed between an end of the barrier and structure forming an end wall of the chamber wherein the nozzle is defined.

11. A printer operating by a method as claimed in claim 1.

12. Droplet deposition apparatus comprising an elongated chamber having at one end thereof a nozzle through which in operation droplets of liquid are ejected from the chamber for deposition, means for varying the pressure of liquid in the chamber by varying the volume of the chamber to effect ejection of said droplets and means for causing a flow of liquid in the chamber in excess of that necessary to replenish the ejected droplets, the flow passing across the nozzle, wherein the chamber is divided longitudinally by a barrier, the liquid flow being in one direction on one side of the barrier and in an opposite direction on the other.

13. Droplet deposition apparatus comprising an elongated chamber having a nozzle through which in operation droplets of liquid are ejected from the chamber for deposition, means for varying the pressure of liquid in the chamber by varying the volume of the chamber to effect ejection of said droplets, means for causing a flow of liquid through the chamber in excess of that necessary to replenish the ejected droplets, the flow passing across the nozzle, and the chamber having a longitudinal barrier around which the flow of liquid passes at an end of the chamber, wherein the chamber is divided longitudinally by the barrier, the liquid flow being in one direction on one side of the barrier and in an opposite direction on the other.

14. Apparatus as claimed in claim 13 wherein the nozzle is in a longitudinal wall of the chamber.

15. Apparatus as claimed in claim 13 comprising at one end of the elongated chamber a plenum chamber through which the liquid flows from one side of the barrier to the other, the plenum chamber being such that pressure waves in the liquid in the elongated chamber are reflected by the liquid in the plenum chamber.

16. Droplet deposition apparatus comprising an elongated chamber having at an end thereof a nozzle through which in operation droplets of liquid are ejected from the chamber for deposition, at least one longitudinal wall of the chamber being formed of piezoelectric material, electrode means for applying a potential difference to the piezoelectric material to deform it in shear mode and thereby effect ejection of said droplets, and a barrier extending longitudinally of the chamber to define a plurality of flow passages therein, an end of the barrier being spaced from the nozzle whereby a flow of liquid from one flow passage to another passes across the nozzle, wherein the chamber is divided longitudinally by the barrier, the liquid flow being in one direction on one side of the barrier and in an opposite direction on the other.

17. Droplet deposition apparatus comprising an elongated chamber having a nozzle through which in operation droplets of liquid are ejected from the chamber for deposition, means for varying the pressure of liquid in the chamber by varying the volume of the chamber to effect ejection of said droplets, means for causing a flow of liquid through the chamber in excess of that necessary to replenish the ejected droplets, the flow passing across the nozzle, and the chamber having at least one longitudinal wall formed of piezoelectric material and a longitudinal barrier around which the flow of liquid passes at an end of the chamber, wherein the barrier extends generally plane-parallel to the longitudinal wall.

18. Droplet deposition apparatus comprising an elongated chamber having at an end thereof a nozzle through which in operation droplets of liquid are ejected from the chamber for deposition, at least one longitudinal wall of the chamber being formed of piezoelectric material, electrode means for applying a potential difference to the piezoelectric material to deform it in shear mode and thereby effect ejection of said droplets, and a barrier extending longitudinally of the chamber to define a plurality of flow passages therein, an end of the barrier being spaced from the nozzle whereby a flow of liquid from one flow passage to another passes across the nozzle, wherein the barrier extends generally plane-parallel to the longitudinal wall.

* * * * *